US007854334B2

(12) United States Patent
Nagel et al.

(10) Patent No.: US 7,854,334 B2
(45) Date of Patent: Dec. 21, 2010

(54) PRODUCT DISPLAY WITH FRONT BARRIER

(75) Inventors: Thomas O. Nagel, Blairstown, NJ (US); Joseph F. Kologe, Scranton, PA (US)

(73) Assignee: Trion Industries, Inc., Wilkes-Barre, PA (US)

( * ) Notice: Subject to any disclaimer, the term of this patent is extended or adjusted under 35 U.S.C. 154(b) by 108 days.

(21) Appl. No.: 12/357,756

(22) Filed: Jan. 22, 2009

(65) Prior Publication Data

US 2010/0181273 A1 Jul. 22, 2010

(51) Int. Cl.
*A47F 1/04* (2006.01)

(52) U.S. Cl. ..... 211/59.3; 211/184; 220/534

(58) Field of Classification Search ..... 211/183, 211/184, 59.2, 59.3, 119.003, 126.1, 232.1; 206/425, 556, 817; 220/532, 534, 529, 535–550, 220/578–580, 771; 312/61, 71; 108/60, 108/61

See application file for complete search history.

(56) References Cited

U.S. PATENT DOCUMENTS

| | | | | | |
|---|---|---|---|---|---|
| 3,559,815 | A * | 2/1971 | Huddleston | ..... | 211/184 |
| 4,512,480 | A * | 4/1985 | Evenson | ..... | 211/11 |
| 4,899,893 | A | 2/1990 | Robertson | | |
| 4,997,094 | A * | 3/1991 | Spamer et al. | ..... | 211/153 |
| 5,433,413 | A * | 7/1995 | Adams | ..... | 248/205.3 |
| 5,450,968 | A * | 9/1995 | Bustos | ..... | 211/59.2 |
| 5,562,217 | A * | 10/1996 | Salveson et al. | ..... | 211/59.3 |
| 5,855,283 | A * | 1/1999 | Johnson | ..... | 211/59.3 |
| 6,186,608 | B1 * | 2/2001 | Pink | ..... | 312/405.1 |
| 6,745,906 | B1 | 6/2004 | Nagel | | |
| 6,866,155 | B2 | 3/2005 | Nagel | | |
| 6,886,700 | B2 | 5/2005 | Nagel | | |
| 6,889,855 | B2 | 5/2005 | Nagel | | |
| 7,032,761 | B2 * | 4/2006 | Nagel | ..... | 211/59.3 |
| 7,063,217 | B2 * | 6/2006 | Burke | ..... | 211/59.3 |
| 7,140,499 | B2 * | 11/2006 | Burke | ..... | 211/59.3 |
| 2002/0088762 | A1 * | 7/2002 | Burke | ..... | 211/59.3 |
| 2002/0125201 | A1 * | 9/2002 | Lamming | ..... | 211/43 |
| 2005/0092702 | A1 * | 5/2005 | Nagel | ..... | 211/59.3 |
| 2006/0226104 | A1 * | 10/2006 | Schmidt | ..... | 211/184 |
| 2007/0170127 | A1 * | 7/2007 | Johnson | ..... | 211/59.3 |

* cited by examiner

*Primary Examiner*—Darnell M Jayne
*Assistant Examiner*—Devin Barnett
(74) *Attorney, Agent, or Firm*—St. Onge Steward Johnston & Reens LLC

(57) ABSTRACT

A standardized or basic product display device is provided with a standard front barrier for identifying and restraining a spring-urged column of displayed products in conjunction with a plurality of secondary barrier elements which can be easily and securely mounted onto the primary barrier to accommodate reconfiguration and enlargement of the display device. The secondary elements have lower portions of inverted U-shaped configuration which can be selectively applied over external edge margins of the primary barrier and secured thereto by locking detents. The secondary barrier element enables the front barrier of the display device to be enlarged, both in width and height to accommodate larger product packages than contemplated for the standard display device in its minimum configuration. In one form, the secondary barrier element has a vertical extension of narrow width, providing effective restraint of tall packages while maximizing visibility of the front of the package.

9 Claims, 6 Drawing Sheets

PRODUCT DISPLAY WITH FRONT BARRIER

BACKGROUND OF THE INVENTION

In the store display of small product items, it is a common practice to provide display trays arranged to receive a plurality of product items in a front-to-back column, with a spring-actuated pusher paddle at the back of the column arranged to automatically move the column forward each time a product is removed from the front of the display. This makes for a more sales-attractive display, by keeping the merchandise always available at the front of the display where it is easily seen and easily removed.

In a typical supermarket or other large store, the products to be displayed come in a wide variety of sizes and shapes. While many such products are displayed on hooks, extending outwardly from perforated panels, products are more efficiently or more effectively displayed and sold from trays of the type mentioned above. The accommodation of different sizes, shapes and package types in these display trays requires trays of a wide variety of configurations, which can lead to the need of a storekeeper to maintain a large inventory of trays of different sizes, shapes, etc. to accommodate the various packaging. This is undesirable both from an investment standpoint and also because of the requirement for handling, storing, changing and installing the various forms of trays as the product mix changes. There thus has been a long-felt need in the trade for product display trays that are adjustable and convertible, such that a single, or a limited number of, basic tray structures can be adjusted and/or modified to accept a wide spectrum of package sizes and shapes.

One advantageous form of adjustable product display tray is represented by U.S. Pat. Nos. 6,745,906, 6,866,155, 6,886,700, 6,889,855 and 7,032,761, the disclosures of which are incorporated herein by reference. These patents are owned by Trion Industries, Inc., assignee of the present invention.

In the patented trays referred to above, among other features, advantageous arrangements are provided for easily changing the effective width of the trays, in order to accommodate packages of different widths. In U.S. Pat. No. 6,886,700, the spring-actuated pusher device, is arranged to removably receive an attachment providing greater height and/or width to the pusher paddle contacting the product column. This provides better control over the product column when displaying products significantly larger in width or height than contemplated for the "standard" tray device.

SUMMARY OF INVENTION

In a "standard" display tray of the type referred to in the above mentioned patents, there is frequently provided a front barrier panel, which is joined in normally fixed arrangement with a front base member of the tray. The barrier panel serves the purpose of providing a front stop for the forwardly urged column of packages, and also provides a forwardly facing surface for product information and pricing. In general, the front barrier panel is of a width appropriate for the display tray when set at its minimum width configuration, and is of a height suitable for relatively smaller sized packages likely to be displayed in the tray. The height and width of the standard front barrier panel may thus be less than optimum for product packages which are larger in height and/or width than the relatively minimum-sized packages. In accordance with one aspect of the invention, secondary barrier elements are provided, which can be securely mounted on the standard front barrier panel, enlarging it both in width and height to accommodate larger sized packages without requiring the merchandiser to change to a larger-sized tray assembly. To this end, the primary barrier panel advantageously is of generally flat form with exposed side and top edges for reception of the secondary barrier elements.

In one embodiment, a secondary barrier is provided which is of generally inverted U-shaped configuration and is provided along its inside edges with spaced apart flange elements forming a groove for the reception of edge margins of the primary barrier panel. When the display tray is to be set up for the handling of larger/wider product packages, and the adjustable side guides thereof are set to a wider-than-minimum configuration, the standard primary barrier panel can be augmented by the mounting thereon of the secondary barrier element, to increase both the width and the height of the front barrier.

In one advantageous form of the secondary barrier element, a reinforcing panel extends downward a distance from the horizontal upper portions of the barrier element. This panel desirably is positioned so as to slide closely behind upper portions of the back surface of the primary barrier, when the secondary barrier element is installed, and serves to rigidify the secondary barrier element as well as the combined parts.

Preferably, the secondary barrier element and the primary barrier panel are provided with interengaging locking detent elements such that, when the secondary barrier element is installed, it is unlikely to be removed or dislodged accidentally.

To advantage, the configuration of the secondary barrier element is such that it engages with the primary barrier only along edge margins of the barrier panel. This leaves the majority of the front surface area of the barrier panel exposed for the display of product information and/or pricing. Typically, the panel-engaging flanges of the secondary barrier element will be continuous. However, the continuity of the flanges may be interrupted, if desired, as long as there is adequate contact between the primary and secondary elements to assure a connection of adequate strength when a secondary barrier element is installed.

In an alternative embodiment of the invention, provision may be made for confinement of tall packages. In this embodiment of the invention, the secondary barrier element is provided with a vertical extension to retain taller packages in the proper display orientation. Desirably, the vertical projection can be relatively narrow as compared to the width setting of the display tray, so as to leave most of the front surface of the front package exposed and visible to the customer. To particular advantage, the vertical extension may also be substantially offset from the center of the barrier panel assembly, and desirably is located at one side edge thereof.

In any of its forms, the front barrier arrangement of the invention provides for a high level of flexibility to the storekeeper to optimize the configuration of display trays to suit the requirements of package sizes and configurations, by enabling basic tray units to be easily and quickly adapted and reconfigured for various packages. The arrangement enables the storekeeper to maintain an inventory of adaptor parts, rather than an extensive inventory of the complete tray assemblies.

For a more complete understanding of the above and other features and advantages of the invention, reference should be made to the following detailed description of preferred embodiments thereof, and to the accompanying drawings.

DESCRIPTION OF PREFERRED EMBODIMENTS

Figure 1:
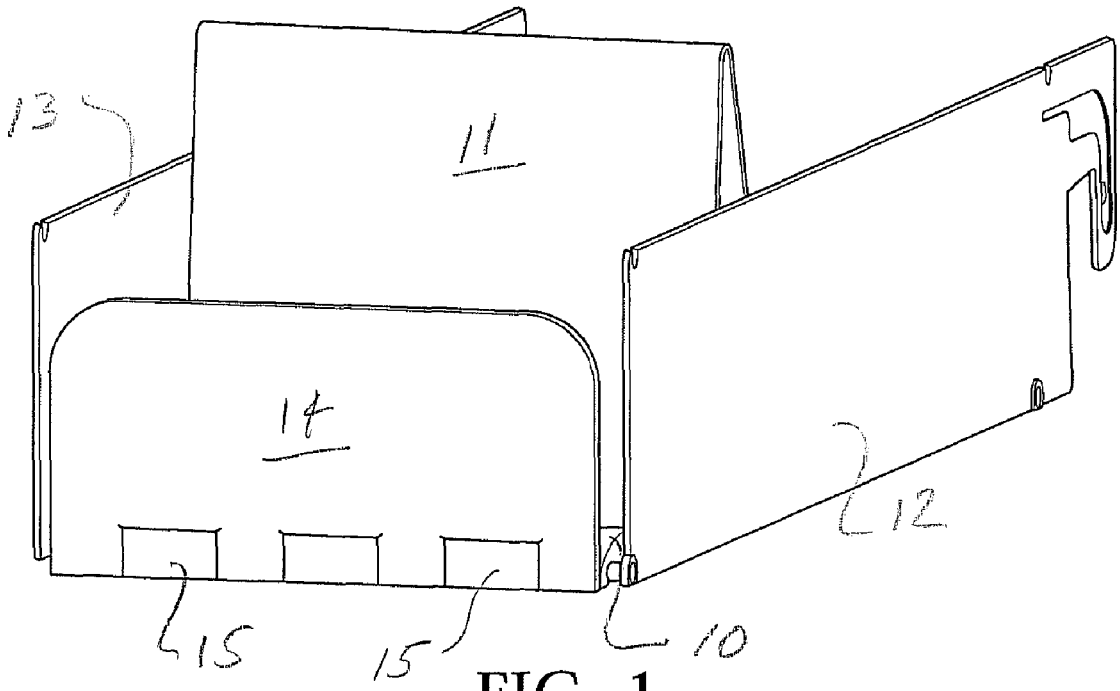
FIG. 1 is a front perspective view of a form of display tray provided with a spring-actuated pusher arrangement and a form of front barrier, configured in its minimum size.
Figure 2:
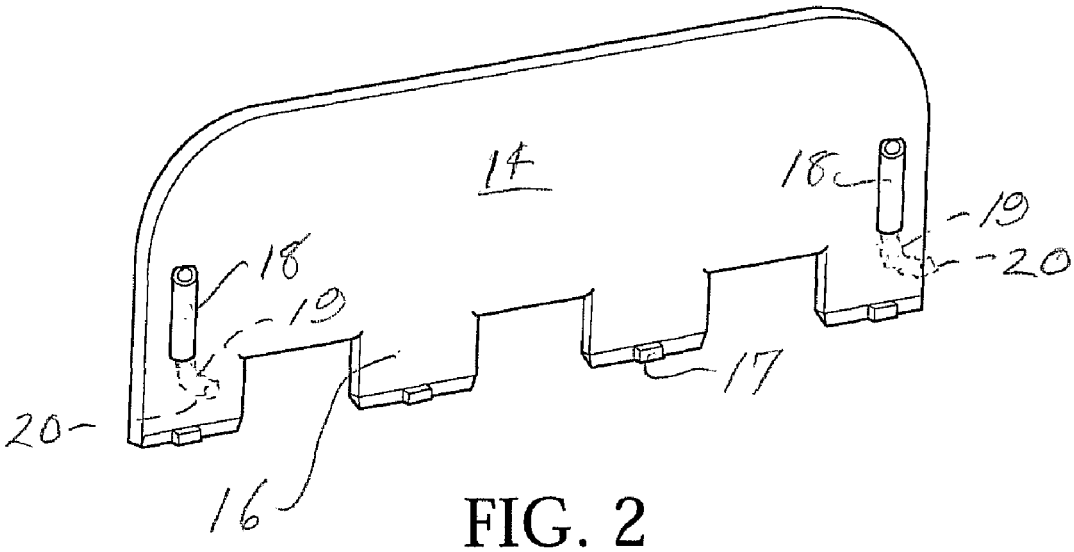
FIG. 2 is a back perspective view of a front barrier panel as incorporated in the display tray of FIG. 1.

Referring now the drawings, and initially to FIGS. 1-7 thereof, FIG. 1 illustrates an advantageous form of display tray of the general type described in the before mentioned U.S. patents and elements which form the subject matter of our copending U.S. application Ser. No. 12/354,398, filed Jan. 15, 2009, which is incorporated herein by reference. The basic tray comprises a base structure (not specifically illustrated), which can be of the general type shown in the Nagel U.S. Pat. No. 6,866,700 referred to above, advantageously consisting of a plurality of longitudinally extending wires mounted by front and back base members, of which a portion of the front base member 10 is illustrated in FIG. 1. A pusher element 11, which is urged forwardly by the action of a coil spring (not shown), is slideably mounted on the base structure. Side guides 12, 13 which may be formed of plates, as shown, wire, or other suitable material, are adjustably mounted in the base members for lateral adjustment to increase or decrease the effective width of the display unit.

At the front of the display unit is a barrier panel 14 advantageously in the form of a flat, sheet-like element of plastic material. As set forth in the Nagel U.S. Pat. No. 7,032,761, the forward base member 10 is formed with a plurality of spaced-apart forward projections 15 which are grooved to receive downwardly projecting mounting tabs 16 of the barrier panel 14. The tabs 16 are provided with retention keys 17 which, when the barrier panel is assembled with the front base member 10, lock the panel in assembled relation, desirably requiring a special tool for its removal.

Preferably, the back surface of the barrier panel 14 is provided, adjacent its side edges, with vertically oriented tubular sockets 18 which are arranged to receive upturned ends 19 of an outermost pair of wires 20 forming part of the base structure. This reinforces the panel against forces applied forwardly or rearwardly to upper portions of the panel.

FIG. 1 of the drawings illustrates a standardized display tray in a minimum configuration with its side plates 12, 13 spaced apart a minimum distance, and the tray otherwise configured for relatively small packages. When the tray is to be configured for larger packages, the side plates 12, 13 are moved outwardly an appropriate distance to accommodate the increased package width.

In accordance with the invention, when the tray is configured for larger packages, a secondary barrier element 21 (FIG. 3) is arranged to be mounted on the primary barrier panel 14, to increase both the size and width of the panel structure. The secondary barrier element 21 is of generally inverted U-shaped configuration, comprised of spaced apart side elements 22, 23 and a horizontally disposed upper element 24 integrally joined with the side elements 22, 23.

As reflected in FIGS. 3-6, the inner edges of the secondary barrier element are provided with a groove 25, formed by spaced apart front and back flanges 26, 27 respectively. Typically, the primary barrier panel 14 will be in the form of a flat panel. In any event, at least edge margins of the panel 14 are of a uniform dimension, to be closely received within the groove 25 and closely confined by the flanges 26, 27. In the illustrated arrangement, the flanges 26, 27 are continuous about the side and upper elements of the secondary barrier 21. However, if desired, the flanges may be discontinuous, as long as they adequately grip and confine the panel 14.

Figure 7:
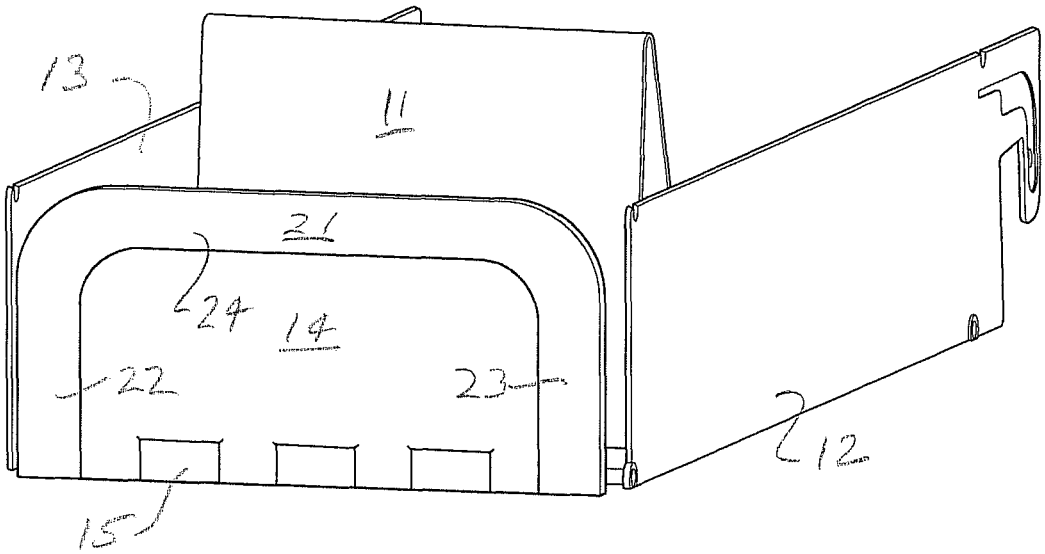
FIG. 7 is a front perspective view of a display tray of the type shown in FIG. 1, modified for packages of greater width and provided with a front barrier assembly incorporating the secondary barrier element of FIG. 3.
Figure 8:
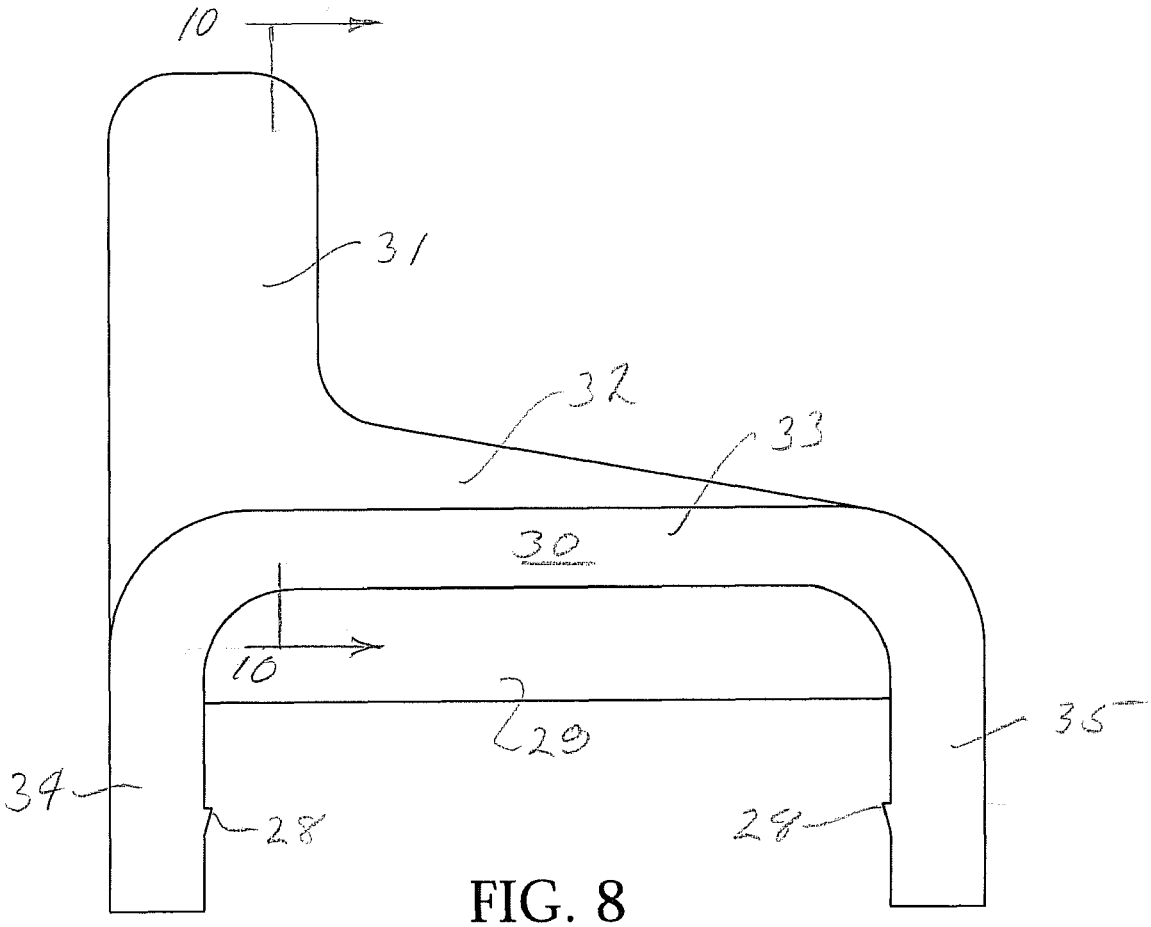
FIG. 8 is a front elevational view of a modified form of secondary barrier element provided with a vertical extension for managing packages of greater than normal height.
Figure 9:
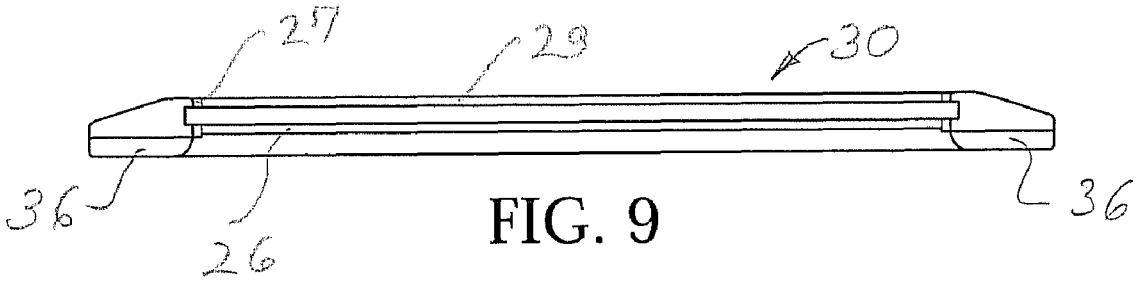
FIG. 9 is a bottom plan view of the barrier element of FIG. 8.
Figure 10:
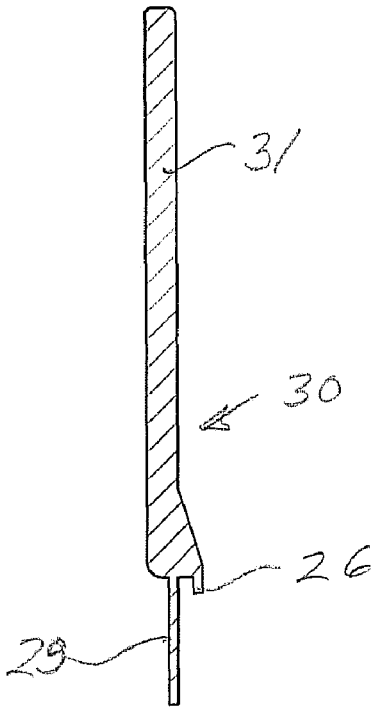
FIG. 10 is a cross sectional view as taken generally on line 10-10 of FIG. 8.

When a display tray is in a widened configuration, as shown in FIG. 7, the secondary barrier element 21 can be applied over the primary barrier 14 to increase both the height and width of the barrier assembly. Desirably, when the secondary barrier element is installed, most of the front face of the barrier panel 14 remains unobstructed so that any information provided thereon is still visible to the customer.

Figure 3:
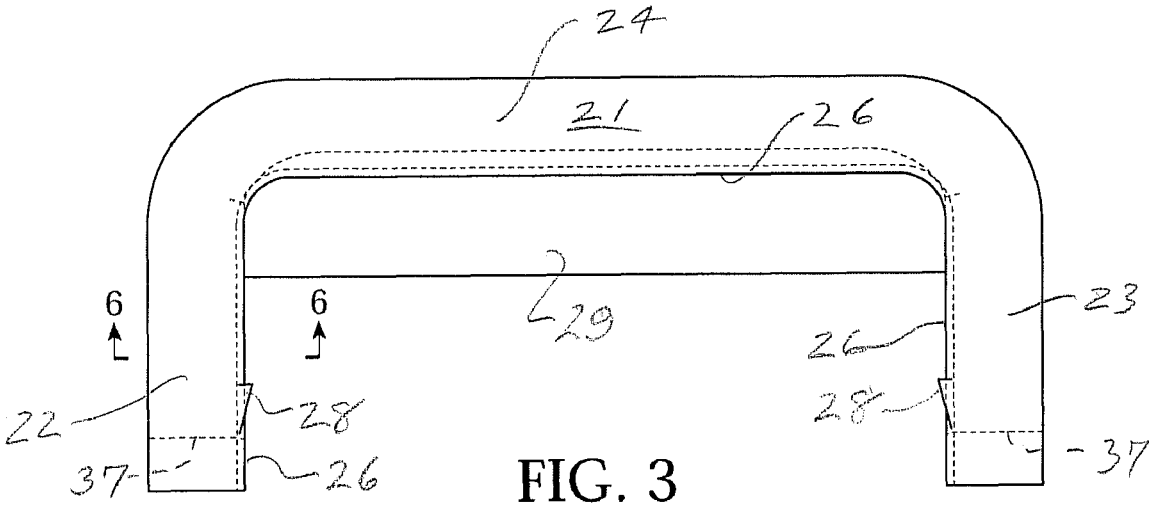
FIG. 3 is a front elevational view of a secondary barrier element designed for assembly with the barrier panel of FIG. 2, to provide an enlarged front barrier structure of greater height and width than the panel of FIG. 2.

To advantage, the side elements 22, 23 of the secondary barrier are provided with locking detents 28 (FIG. 3). In the illustrated arrangement, these detents are formed on both of the flanges 26, 27.

A strengthening and reinforcing panel 29 desirably extends across the upper portion of the secondary barrier element 24, between the side elements 22, 23 thereof. In the illustrated arrangement, the panel 29 extends from the rear flange 27. Thus, when the secondary element 24 is installed, the panel 29 slides downward along the back face of the primary panel 14.

The locking detents 28, which extend from the back flange 27, are positioned to engage the bottoms of the tubular sockets 18 to lock the secondary element 24 in installed position against accidental dislodgement or removal.

If desired, locking elements (not shown) may be provided on the front of the primary panel 14, for engagement with the front set of locking detents 28.

The secondary barrier element 24 allows the front barrier structure of the display to be quickly reconfigured, when the width of the tray is increased providing for a neater appearing display with better control of the products displayed.

An alternative embodiment of the invention is shown in FIGS. 8-12. In the alternative embodiment, the secondary barrier element 30 is comprised of a lower portion which can be generally identical in construction to the secondary barrier element 21 shown in FIGS. 3-6. The barrier element 30, however, includes a vertical extension 31, which significantly extends the effective height of the secondary barrier element. The extension 31 can be molded with the remaining portions of the barrier element 30 and forms an integral part thereof.

Desirably, the vertical extension 31 is of substantially less width than the overall width of the element 30 so as to maximize the visibility to the customer of packages in a column behind the barrier element. Additionally, the vertical extension preferably can be located at one side edge of the barrier element 30 to provide better continuity of the visible portions of the packages behind the barrier. For extra strength, the lowermost portion 32 of the vertical extension may extend partly or completely across the top of the upper element 33 thereof for added strength.

Figure 4:
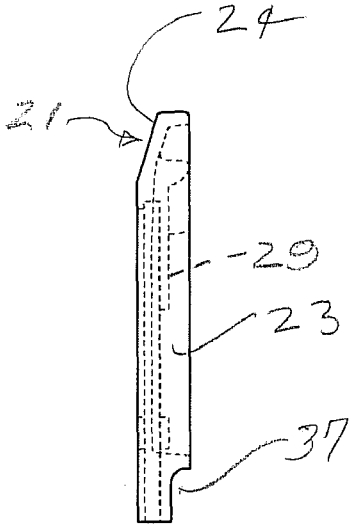
FIG. 4 is a side elevational view of the secondary barrier element of FIG. 3.
Figure 5:
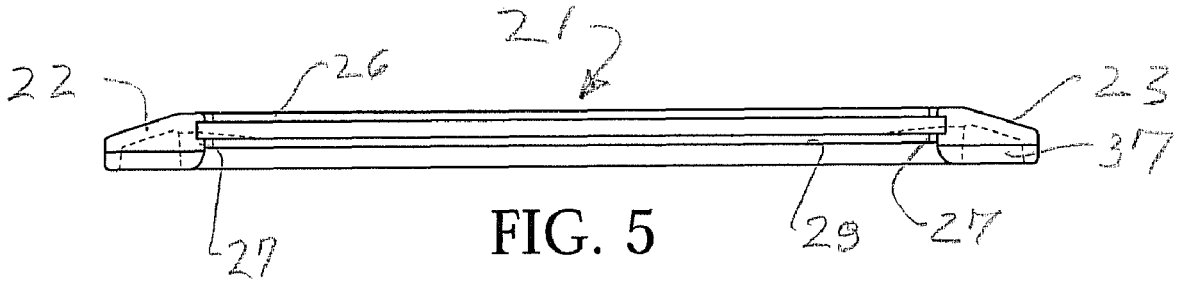
FIG. 5 is a bottom plan view of the barrier element of FIG. 3.
Figure 6:
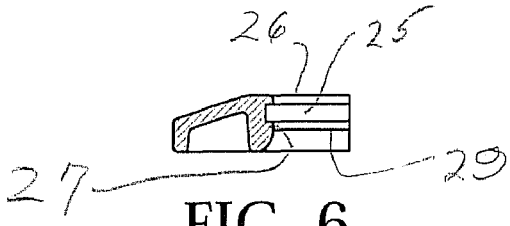
FIG. 6 is a cross sectional view as taken generally on line 6-6 of FIG. 3.
Figure 11:
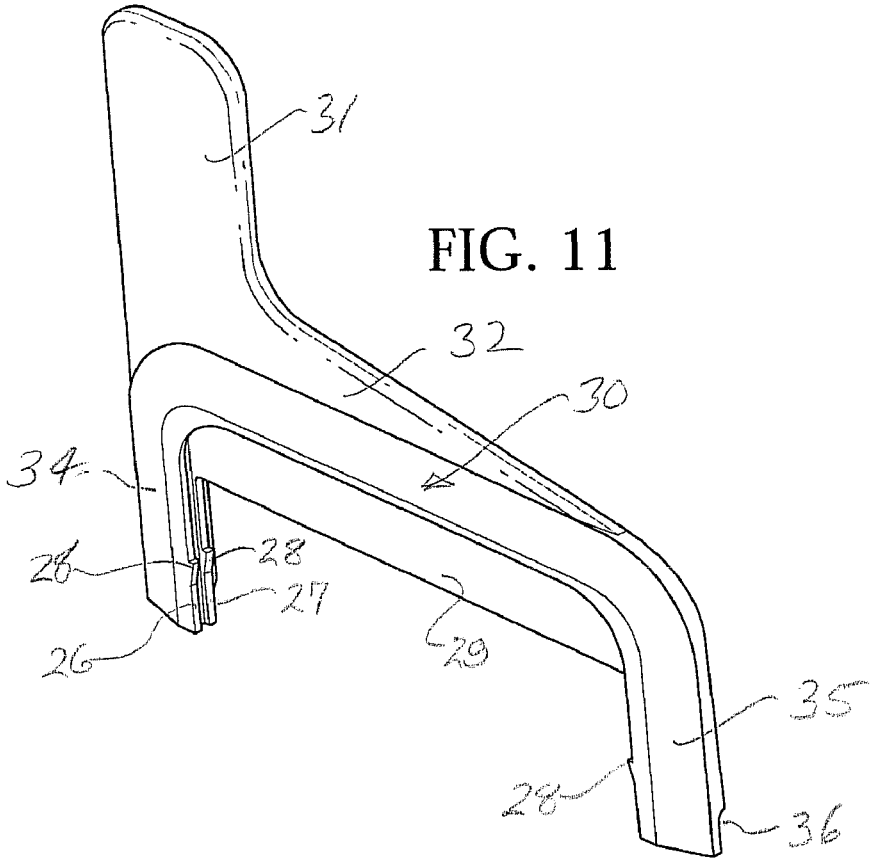
FIG. 11 is a perspective view of the alternative form of barrier element of FIG. 8.
Figure 12:
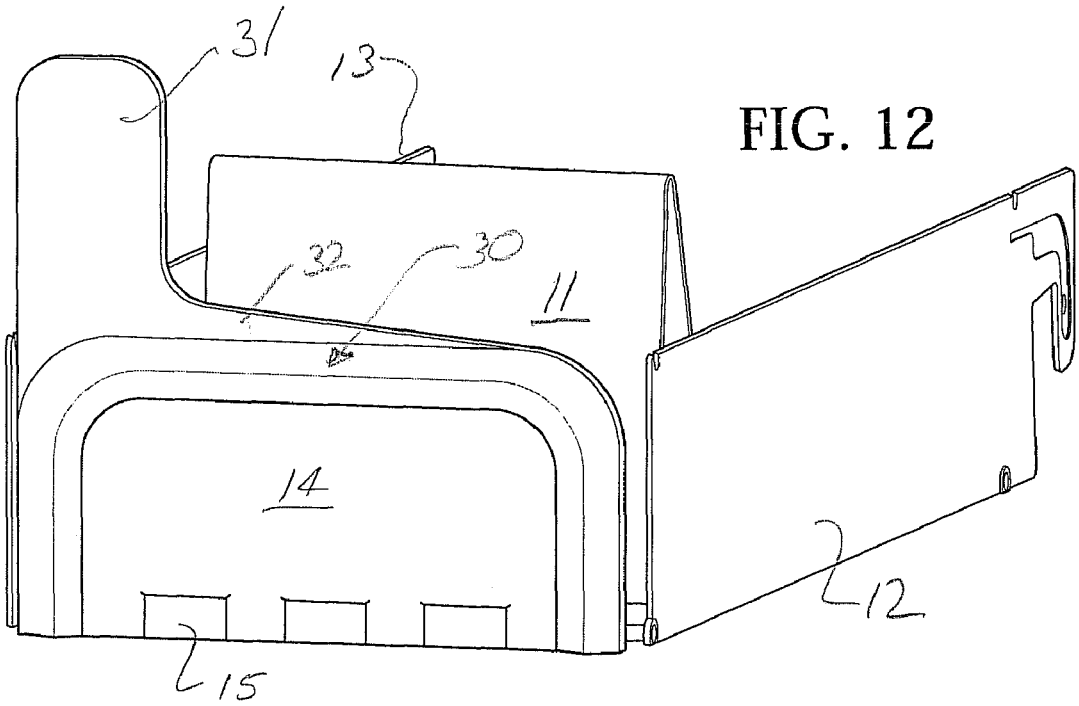
FIG. 12 is a front perspective view of a display tray of the general type shown in FIG. 1, modified to receive packages of greater width and height and incorporating a secondary barrier element of the type shown in FIG. 8.

As shown particularly in FIG. 11, the barrier element 30 has front and back flanges 26, 27 and a reinforcing panel 29, in the same manner as the first described embodiment of the invention. In addition, locking detents 28 are provided to make the assembly of the primary barrier panel 14 and the secondary barrier element 30 secure against unintended separation. The side elements 34, 35 of the barrier element 30 advantageously are notched out at 36 to accommodate the presence of the forward base member 10 at the front of the base structure. In a similar manner, the secondary barrier element 24 of the first embodiment can be notched out at 37 (FIGS. 3 and 4).

As can be appreciated from the heretofore described embodiments, the secondary barrier element may take a number of forms and sizes to suit particular requirements. Indeed, individual forms and styles of secondary barrier elements may be tailored to particular products and package styles to optimize display effectiveness.

By enabling a standard barrier panel to be efficiently and effectively modified by an easily mountable, attractive appearing secondary barrier element, the options made available to the storekeeper, with a minimum inventory requirement for display equipment are greatly enlarged. To the greatest extent practicable, the storekeeper can maintain an inventory of standard, basic display units, together with optimizing attachments that can be installed to enable the basic display device to be enlarged and reconfigured for various forms and sizes of packaging.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

The invention claimed is:

1. A product display device comprising a base structure for supporting a plurality of products, a spring actuated pusher mounted on said base structure for urging products toward the front, product confining side guides mounted on opposite sides of said base structure for lateral adjustment with respect thereto, and a front barrier mounted at the front of said base structure and extending upward above a product support plane defined by said base structure, wherein said front barrier comprises (a) an upwardly extending primary barrier panel fixed to said base structure at a forward end thereof, said primary barrier panel being of generally flat plate-like construction having front and back surfaces and side and top edges, (b) said primary barrier panel having a width dimension not greater than a width of said side guides when said side guides are set in a minimum width configuration, (c) a secondary barrier element removably mounted on said primary barrier panel, (d) lower portions of said secondary barrier element being of a generally inverted U-shaped configuration and comprising spaced apart barrier side elements and a horizontally disposed upper barrier element integral with and connecting upper portions of said side elements, and (e) said secondary barrier element having a means for closely embracing peripheral areas of the top and side margins of said primary barrier panel to grip and confine said primary barrier panel on front and back surface areas thereof.

2. A product display device according to claim 1, wherein (a) detent means are provided on said side elements engageable with elements of said primary barrier panel for releasable retention of said secondary barrier element on said primary barrier panel.

3. A product display device comprising a base structure for supporting a plurality of products, a spring actuated pusher mounted on said base structure for urging products toward the front, product confining side guides mounted on opposite sides of said base structure for lateral adjustment with respect thereto, and a front barrier mounted at the front of said base structure and extending upward above a product support plane defined by said base structure, wherein said front barrier comprises (a) a primary barrier panel fixed to said base structure at a forward end thereof, said primary barrier panel being of generally flat plate-like construction having front and back surfaces and side and top edges, (b) said primary barrier panel having a width dimension not greater than a width of said side guides when said side guides are set in a minimum width configuration, (c) a secondary barrier element removably mounted on said primary barrier panel, (d) lower portions of said secondary barrier element being of a generally inverted U-shaped configuration and comprising spaced apart barrier side elements and a horizontally disposed upper barrier element integral with and connecting upper portions of said side elements, (e) said secondary barrier side elements having elements closely embracing peripheral areas of said primary barrier panel on front and back surface areas thereof, and (f) said secondary barrier element comprises a groove formed along inside edges of said side and upper elements for reception and confinement of peripheral side and top edge margins of said primary barrier panel.

4. A product display device according to claim 3, wherein (a) said secondary barrier element comprises a reinforcing panel extending downward from the upper element thereof adjacent upper portions of the back surface of said primary barrier panel.

5. A product display device comprising a base structure for supporting a plurality of products, a spring actuated pusher mounted on said base structure for urging products toward the front, product confining side guides mounted on opposite sides of said base structure for lateral adjustment with respect thereto, and a front barrier mounted at the front of said base structure and extending upward above a product support plane defined by said base structure, wherein said front barrier comprises (a) a primary barrier panel fixed to said base structure at a forward end thereof, said primary barrier panel being of generally flat plate-like construction having front and back surfaces and side and top edges, (b) said primary barrier panel having a width dimension not greater than a width of said side guides when said side guides are set in a minimum width configuration, (c) a secondary barrier element removably mounted on said primary barrier panel, (d) lower portions of said secondary barrier element being of a generally inverted U-shaped configuration and comprising spaced apart barrier side elements and a horizontally disposed upper barrier element integral with and connecting upper portions of said side elements, (e) said secondary barrier side elements having elements closely embracing peripheral areas of said primary barrier panel on front and back surface areas thereof, (f) detent means are provided on said side elements engageable with elements of said primary barrier panel for releasable retention of said secondary barrier element on said primary barrier panel, and (g) projecting elements on a surface of the primary barrier panel, adjacent to the side edges of the primary barrier panel, (h) said detent means comprising projections extending laterally inward from said secondary barrier side element and positioned to be releasably engageable with the projecting elements of said primary barrier panel.

6. A product display device according to claim 5, wherein (a) said projecting elements of said primary barrier panel comprise vertically oriented tubular protrusions on the back surface of said primary barrier panel engaged with upturned wire elements forming a part of said base structure.

7. A product display device according to claim 1, wherein (a) said secondary barrier element includes a package retainer element extending upward from said upper barrier element for restraining tall packages being urged forwardly by said pusher, and (b) said package retainer element has a width substantially less than a combined width of said primary barrier panel and said secondary barrier element.

8. A product display device according to claim 7, wherein (a) said package retainer element is offset substantially from a centerline of said display device.

9. A product display device according to claim 8, wherein (a) said package retainer element is substantially aligned with one side edge of said secondary barrier element.

* * * * *